United States Patent [19]

Haake et al.

[11] Patent Number: 4,994,008

[45] Date of Patent: Feb. 19, 1991

[54] MACHINE FOR PRODUCING CONTAINER BLANKS FROM FLAT STOCK

[75] Inventors: Robert A. Haake; Steven R. Woodside, both of Kansas City; Ronald O. Cowell, Independence, all of Mo.

[73] Assignee: RSR Machine Builders, Inc., Kansas City, Mo.

[21] Appl. No.: 497,897

[22] Filed: Mar. 23, 1990

Related U.S. Application Data

[63] Continuation of Ser. No. 359,960, Jun. 1, 1989, abandoned.

[51] Int. Cl.[5] ..... B31B 1/16; B31B 1/25

[52] U.S. Cl. ..... 493/2; 493/1; 493/355

[58] Field of Search ..... 493/1, 2, 3, 59, 354, 493/355

[56] References Cited

U.S. PATENT DOCUMENTS

| | | | |
|---|---|---|---|
| 2,258,880 | 10/1941 | Bobst | 493/354 |
| 2,425,041 | 8/1947 | Luehrs | 493/354 |
| 3,308,723 | 3/1967 | Bergh | 493/354 |
| 4,816,015 | 3/1989 | Holder et al. | 493/355 |

FOREIGN PATENT DOCUMENTS

| | | | |
|---|---|---|---|
| 133823 | 3/1985 | European Pat. Off. | 493/1 |
| 189909 | 8/1986 | European Pat. Off. | 493/59 |

*Primary Examiner*—William E. Terrell

*Attorney, Agent, or Firm*—Hovey, Williams, Timmons & Collins

[57] ABSTRACT

A container blank forming machine is disclosed which allows an operator to quickly form container blanks in accordance with operator selected container type and dimensions. The preferred machine includes a framework having a flat stock support bed, selectively activatable and shiftable cutting heads, a computer, and a touch screen monitor. In operation, the computer causes the monitor to display a selection of container types to which the operator responds with a selection and specific finished container dimension data. The operator then enters flat stock into the machine which automatically cuts and scores the flat stock to form a completed container blank in accordance with the container type selection and dimensions provided by the operator.

15 Claims, 12 Drawing Sheets

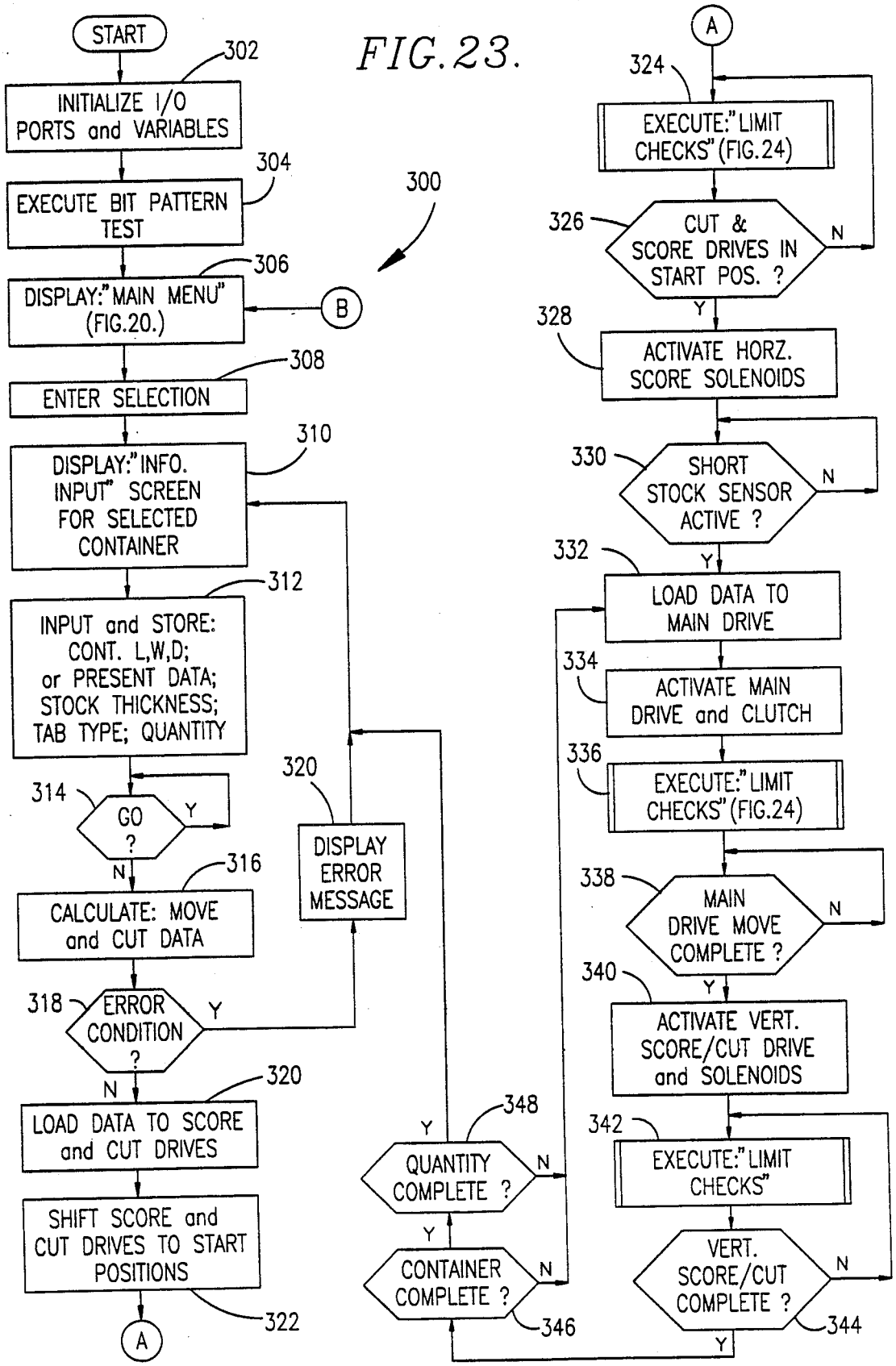
FIG. 23.
300
START
302
INITIALIZE I/O PORTS and VARIABLES
304
EXECUTE BIT PATTERN TEST
306
DISPLAY:"MAIN MENU" (FIG.20.)
B
308
ENTER SELECTION
310
DISPLAY:"INFO. INPUT" SCREEN FOR SELECTED CONTAINER
312
INPUT and STORE: CONT. L,W,D; or PRESENT DATA; STOCK THICKNESS; TAB TYPE; QUANTITY
314
GO ?
Y
N
316
CALCULATE: MOVE and CUT DATA
318
ERROR CONDITION ?
Y
N
320
DISPLAY ERROR MESSAGE
320
LOAD DATA TO SCORE and CUT DRIVES
SHIFT SCORE and CUT DRIVES TO START POSITIONS
322
A
A
324
EXECUTE:"LIMIT CHECKS"(FIG.24)
326
CUT & SCORE DRIVES IN START POS. ?
N
Y
328
ACTIVATE HORZ. SCORE SOLENOIDS
330
SHORT STOCK SENSOR ACTIVE ?
N
Y
332
LOAD DATA TO MAIN DRIVE
334
ACTIVATE MAIN DRIVE and CLUTCH
336
EXECUTE:"LIMIT CHECKS"(FIG.24)
338
MAIN DRIVE MOVE COMPLETE ?
N
Y
340
ACTIVATE VERT. SCORE/CUT DRIVE and SOLENOIDS
342
EXECUTE:"LIMIT CHECKS"
VERT. SCORE/CUT COMPLETE ?
N
Y
344
348
QUANTITY COMPLETE ?
Y
N
CONTAINER COMPLETE ?
Y
N
346

MACHINE FOR PRODUCING CONTAINER BLANKS FROM FLAT STOCK

This application is a continuation; of application Ser. No. 07/359,960, filed June 1, 1989 abandoned.

BACKGROUND OF THE INVENTION

1. Field of the Invention

The present invention concerns a machine for producing container blanks from flat stock. More particularly, the invention hereof concerns a machine for automatically producing short runs of container blanks from an operator input specifying the type of container and interior dimensions, among other data.

2. Description of the Prior Art

Typical machines for producing corrugated containers or boxes are designed for mass production in order to maximize efficiency. As a result of this design, these machines cannot be set up economically for short runs such as 100 boxes or less. Small quantities of containers are needed, however, in various applications such as in distribution warehouses for large retailers where relatively small quantities of returned goods must be boxed for return to the manufacturer.

Because it is not economical for most major corrugated manufacturers to produce the short runs, small quantities of container blanks are typically produced on site. In order to accomplish this, trained personnel are needed to calculate the score and cut dimensions and locations required for a desired corrugated box, for example, based on required interior dimensions of the assembled container. Available prior art cutting and scoring devices are not automated and thereby require each score and cut to be separately made as directed by the operator. Even after the calculations for the scores and cuts are made, considerable labor is still involved to set up and produce each blank.

SUMMARY OF THE INVENTION

The prior art problems outlined above are solved by the container blank forming machine of the present invention. That is to say, the blank forming machine hereof allows relatively unskilled personnel to produce container blanks quickly, efficiently, and automatically without the need for manual operation or direction of cutting and scoring equipment, and without the need for calculating dimensions of the finished blank.

Broadly speaking, the blank forming machine hereof includes a frame presenting a generally upright bed, a score, cut, and drive assembly, a computer, and a touch screen monitor for operator interface. In use, the touch screen monitor presents a menu having images of a wide variety of container types for touch selection by the operator. The operator is then prompted to input the interior dimensions of the finished container. After placement of flat stock, the machine then automatically scores and cuts the stock to produce a container blank ready to be formed into the selected container type having the desired interior dimensions.

Preferred forms of the machine present a tilt bed which allows convenient and easy feeding and removal of flat stock and allows the machine to take up relatively little floor space. Other preferred aspects of the present invention are explained further hereinbelow.

BRIEF DESCRIPTION OF THE DRAWING FIGURES

FIG. 23 is a computer program flowchart of the MAIN LOOP routine for operating the computer.

DETAILED DESCRIPTION OF THE PREFERRED EMBODIMENT

1. Component Structure

A. Mechanical Structure

Figure 1:
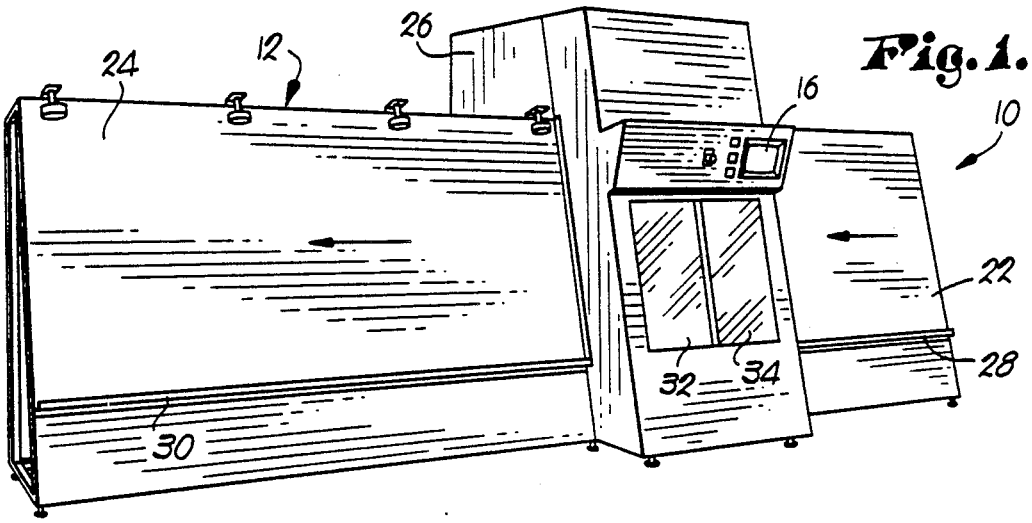
FIG. 1 is a front perspective view of the preferred machine for forming container blanks from flat stock.

Turning now to the drawing figures, container blank forming machine 10 is illustrated in a frontal perspective view in FIG. 1 and finds broad utility in forming container blanks from flat stock such as corrugated, cardboard, and even light sheet metal if desired. Machine 10 broadly includes framework 12 (FIGS. 1–16), score, cut, and drive assembly 14 (FIG. 2–16), touch screen monitor 16 (FIGS. 1, 17, 21, and 22), and computer 18 (FIG. 17 with the program illustrated in FIGS. 23 and 24).

Framework 12 is generally and conventionally composed of steel, square tubing members 20, and further includes flat, sheet metal, infeed bed 22, flat, sheet metal outfeed bed 24, and assembly enclosure 26.

Framework members 12 preferably present infeed and outfeed beds 22,24 in a generally aligned upright configuration but tilted toward the rearward side of machine about 15° from vertical. This feature reduces the amount of required floorspace which makes operation more convenient for the operator. The lower edges of infeed and outfeed beds 22,24 respectively include U-shaped support troughs 28 and 30 adjacent the lower edges thereof for respectively supporting infeed flat stock and completed blanks adjacent infeed and outfeed beds 22,24.

Assembly enclosure 26 is generally composed of sheet metal and encloses score, cut, and drive assembly 14, touch screen monitor 16, and computer 18 with monitor 16 presented for convenient viewing by an operator as illustrated in FIG. 1. Enclosure 26 preferably includes a pair of LEXAN doors 32 and 34 allowing the operator to view the operation of assembly 14 and to allow access for repair or adjustment.

Score, cut, and drive assembly 14 broadly includes hydraulic pump 36 (Continental's brand, Model PV-101), main drive assembly 38, vertical score/cut assembly 40, upper horizontal score assembly 42, lower horizontal score assembly 44, and horizontal cut assembly 46.

Hydraulic pump 36 (schematically illustrated in FIG. 18) is a motor-driven unit included in machine 10 to supply motive power to main drive assembly 38 and vertical score/cut assembly 40. Hydraulic pump 36 is included for this application in order to apply rapid reversing movement of the components of assemblies 38 and 40. Additionally, hydraulic motors can be less expensive than electrical motors for performing the rapid reversing movements.

Figure 2:
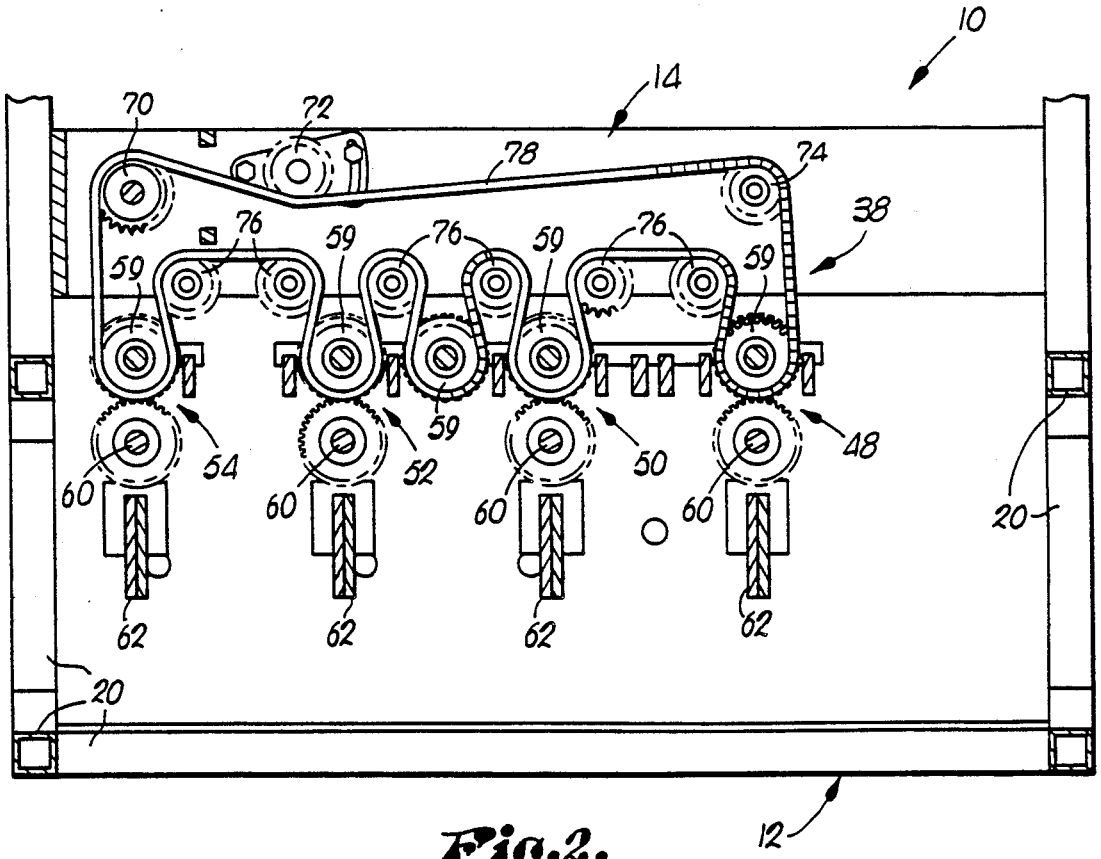
FIG. 2 is a top, horizontal sectional view showing the drive train for the main drive.
Figure 4:
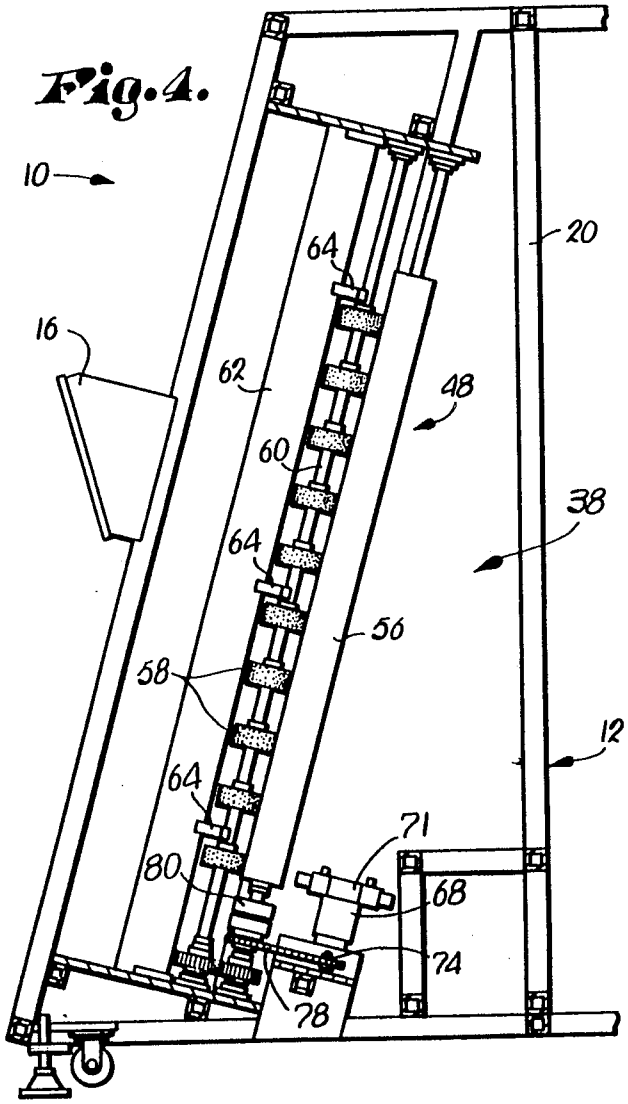
FIG. 4 is a vertical sectional view taken along line 4—4 of FIG. 3 showing the main drive feed rolls.
Figure 8:
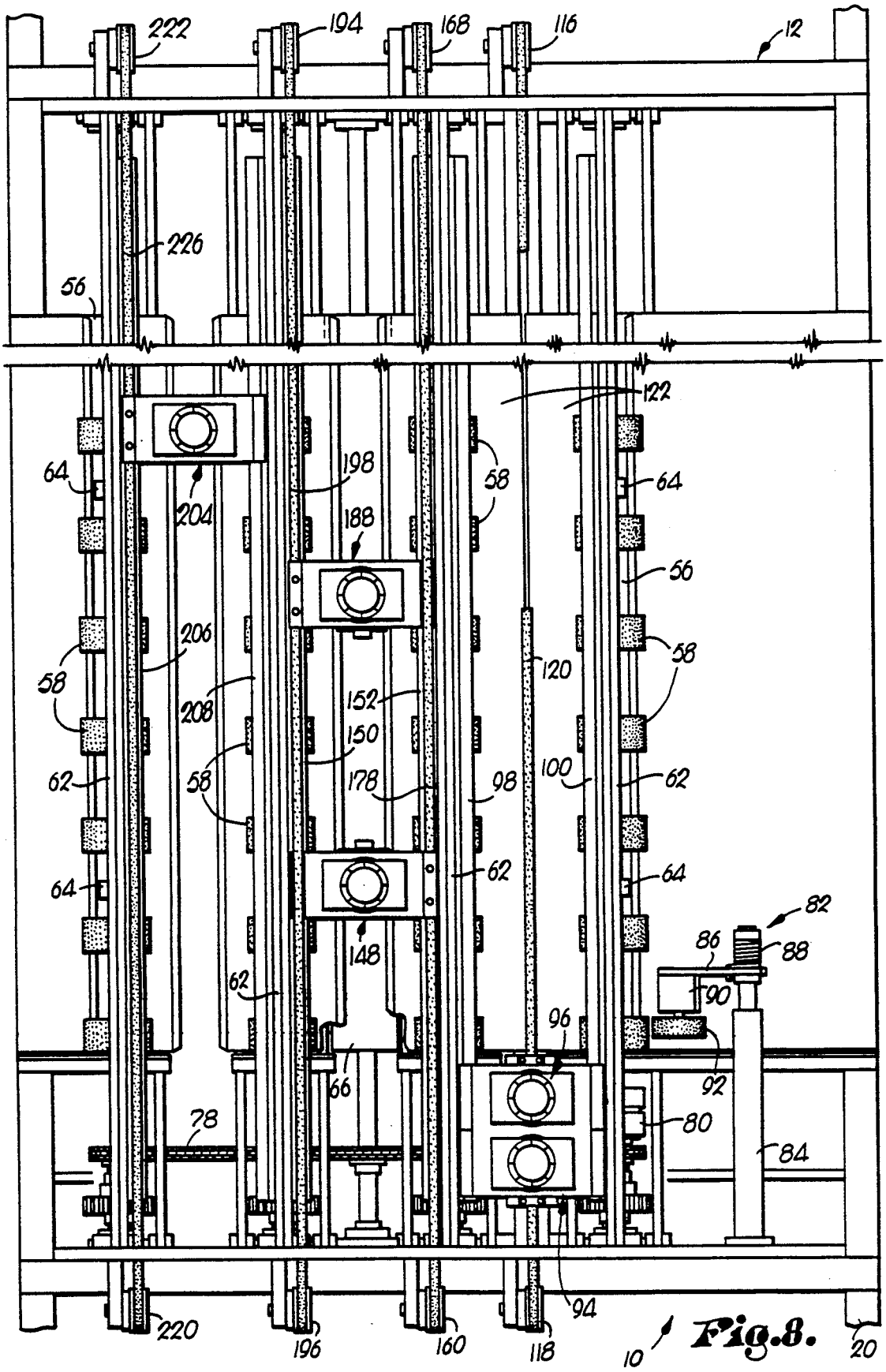
FIG. 8 is an enlarged fragmentary front elevational view showing the vertical and horizontal scoring and cutting heads, feed rolls, and other operative components.

Referring generally to FIGS. 2, 4, and 8, main drive assembly 38 includes four pairs of drive rolls 48, 50, 52, and 54 (FIG. 2), each pair of which are gear interconnected and include an inboard steel roller 56 and an outboard neoprene-coated, segmented roller 58 presenting a central roller shaft 60 (FIG. 4). Each inboard roller 56 includes a respective drive sprocket 59 adjacent the lower end thereof (FIG. 2).

As best viewed in FIG. 2, drive roll pairs 48–54 are configured in a spaced-apart relationship with the nip between each pair lying in a plane coincident with infeed and outfeed beds 22,24 so that flat stock progresses from the right through the nips of the drive roll pairs 48–54 and exits to the left as viewed in FIGS. 1 and 2.

Because of the segmented nature of outboard rollers 58, respective support structures 62 extend the entire length thereof and present inwardly extending, cast bronze steady bearings 64 (FIG. 4) engaging roller shaft 60 at three spaced-apart locations along the length of each roller shaft 60 as best viewed in FIG. 4.

Main drive assembly 38 also includes scoring support roller 66 located between drive roll pairs 50 and 52 and constructed the same as inboard rollers 56.

Main drive assembly 38 further includes hydraulic motor 68 (FIG. 10) (Ross Model-02) presenting motor drive sprocket 70 (FIG. 2) coupled with the output shaft thereof and electrically actuated hydraulic valve 71, tension/take-up sprocket 72, corner idler sprocket 74, six intermediate idler sprockets 76, endless roller drive chain 78 intercoupling sprockets 70–76 by way of the respective roller drive sprockets 59 included with inboard rollers 56 and scoring support roll 66.

During operation, hydraulic motor drive sprocket 70 rotates in a clockwise direction in order to impart clockwise rotation to each inboard roll 56 and thereby counterclockwise rotation to each outboard roll 58. This results in the feed of flat stock from the right to the left as viewed in FIGS. 1 and 2.

Electrically actuated, pneumatically operated clutch 80, disposed in the shaft of inboard roller 56 of infeed drive roll pair 48, is electrically activated by computer 18 and mechanically disengages in the event of an overload or jam-up of drive roll pair 48.

Main drive assembly 38 additionally includes main drive encoder unit 82 comprising mounting pedestal 84, horizontally disposed support arm 86 preferably coupled with pedestal 84 and biased inwardly by spring 88, downwardly extending encoder 90 mounted to the outboard end of support arm 86 and presenting flat stock engagement roller 92. Encoder 90 tracks the movement of flat stock through machine 10 as explained further hereinbelow.

Figure 3:
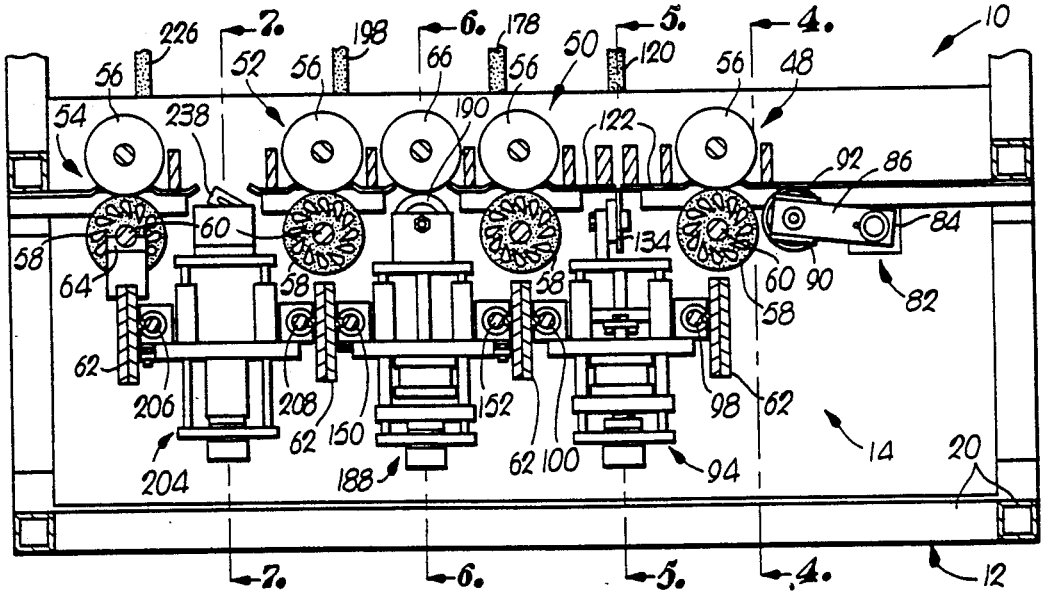
FIG. 3 is a horizontal sectional view showing the main drive rollers and the scoring and cutting heads.

FIGS. 3, 5, and 8–11 illustrate vertical score/cut assembly 40 which includes scoring head 94, cutting head 96 connected to and above scoring head 94, left and right guide rails 98 and 100 (FIG. 3), hydraulic drive motor 102 (Ross Model-02) (FIG. 5)) including drive sheave 104 and electrically operated hydraulic valve 106 (FIGS. 15,16), drive idler sheave 108, encoder 110 (Encoder Products Model 716-15-600PR-S-S-6-D-S-Y) including encoder sheave 112 coupled thereto, corner idler sheave 114, upper and lower guide idler sheaves 116 and 118 (FIG. 5), and cogged V-belt 120. As best viewed in FIG. 3, scoring and cutting heads 94,96 traverse the area between drive roll pairs 48 and 50 (FIG. 3) and provide vertical cut and score functions against backing plate 122 (FIG. 3). Vertical score/cut assembly 40 also includes upper and lower limit switches 124 and 126.

Scoring head 94 (FIG. 9) includes conventional pneumatic cylinder 128 electrically actuated by conventional solenoid valve 130, pneumatically and axially shiftable scoring block 132 including circular, rotatable scoring disc 134, and left and right guide blocks 136 and 138 (FIG. 10) which includes open type linear ball bushings for slidable coupling with spaced, left and right guide rails 98,100 which extend generally upright in a plane parallel to infeed and outfeed beds 22,24.

Cutting head 96 is coupled to and above scoring head 94 and is similarly configured to include pneumatic cylinder 140, solenoid valve 142, cutting block 144 presenting circular rotatable cutting blade 146. As best viewed in FIG. 11, cutting blade 146 is rotatably coupled with cutting block 144 and preferably configured for convenient replacement. Cutting head 96 also includes a respective pair of left and right guide blocks (not shown) identical to those of blocks 136,138.

Figure 9:
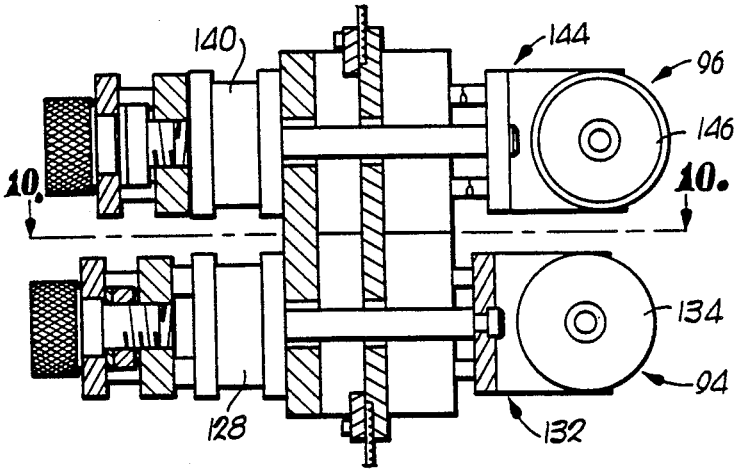
FIG. 9 is an enlarged vertical sectional view through the vertical score and cutting heads.
Figure 10:
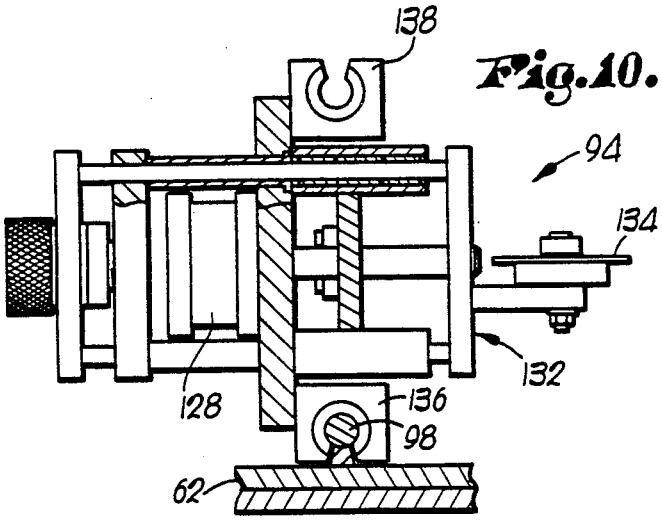
FIG. 10 is a horizontal sectional view taken along line 10—10 of FIG. 9 showing the vertical scoring head.
Figure 11:
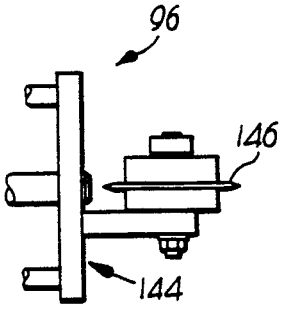
FIG. 11 is a fragmentary view of the vertical cut blade assembly.
Figure 5:
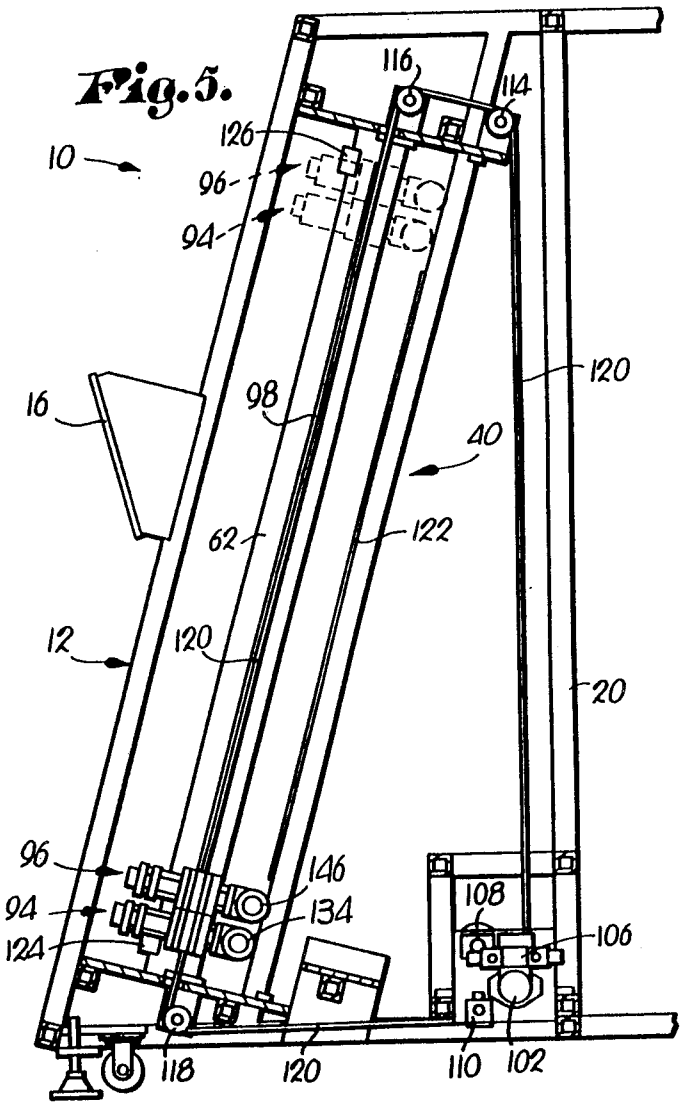
FIG. 5 is a vertical sectional view taken along line 5—5 of FIG. 3 showing the vertical score and cut heads and vertical score/cut drive unit.

One end of V-belt 120 is connected to the upper portion of cutting head 96 and extends upwardly around upper guide idler sheave 116, corner idler sheave 114 to drive sheave 104 (FIG. 5). V-belt 120 then wraps about drive idler sheave 108 and encoder sheave 112 (FIG. 15) to extend horizontally to lower guide idler sheave 118 and then upwardly to attach to the lower side of score head 94 (FIG. 9). In operation, reversible hydraulic drive motor 102 shifts heads 94,96 along the length of guide rails 98,100 between upper and lower limit switches 124, 126 As explained further hereinbelow, encoder 110 provides feedback concerning the position of scoring and cutting heads 94,96. FIG. 5 illustrates the position of scoring and cutting heads 94,96 in the lowermost position against lower limit switch 124, and illustrates the upper limit of travel in phantom lines against upper limit switch 126.

Upper and lower horizontal score assemblies 42,44 are illustrated in FIGS. 3, 6, 7, 8, 12, and 14. Assemblies 40,42 are located generally between drive roll pairs 50 and 52.

Figure 12:
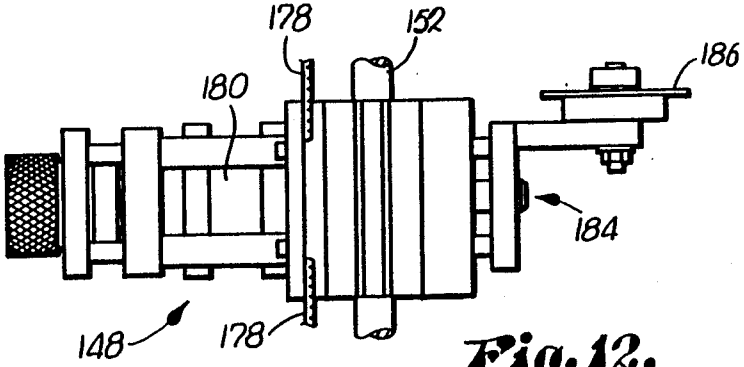
FIG. 12 is an enlarged side elevational view of the lower horizontal scoring head.
Figure 15:
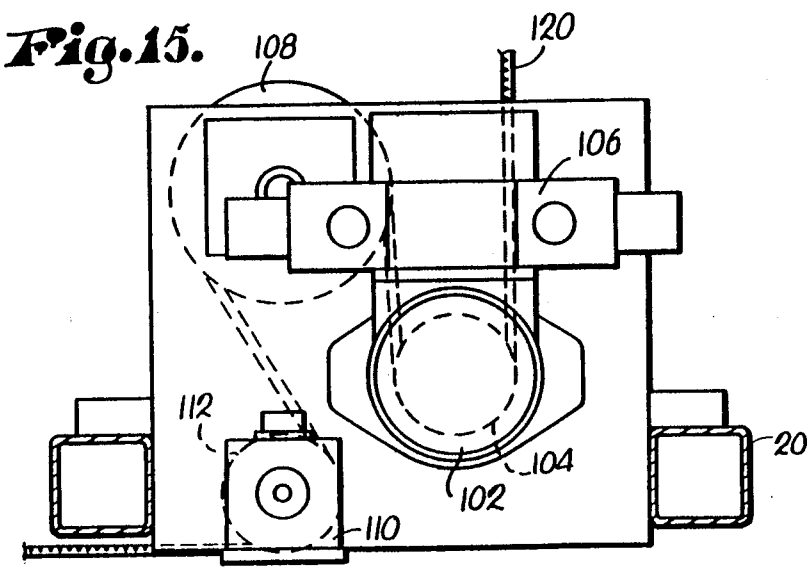
FIG. 15 is an enlarged side elevational view of vertical score/cut drive unit with the V-belt path shown in dashed lines.

Lower horizontal score assembly 44 includes lower scoring head 148, left and right guide rails 150 and 152, electric D.C. drive motor 154 including drive sheave 156, drive idler sheave 158, encoder 160 including encoder sheave 162, lower corner idler sheave 164, lower guide sheave 166, upper guide sheave 168, upper corner idler sheave 170, lower limit switch 174, and stop limit switch 176. Lower scoring head 148 is similar to vertical scoring head 94 and includes pneumatic cylinder 180 actuated by solenoid valve 182, scoring block 184 which is pneumatically and axially extendable and presents circular, rotatable vertical scoring disk 186 oriented in a plane transverse to that of scoring disk 134 in order to produce horizontal scorings on flat stock passing through machine 10 (FIG. 12).

Belt 178 (FIG. 6) extends upwardly from the rightward edge of lower horizontal scoring head 148 to upper guide sheave 168, corner idler sheave 170, drive sheave 156, drive idler sheave 158, encoder sheave 162, lower corner idler sheave 164, lower guide sheave 166, and returns to lower scoring head 148 on the rightward edge thereof.

Upper horizontal score assembly 42 includes upper scoring head 188 which is mounted above lower scoring head 148 on the same left and right guide rails 150,152. Upper scoring head 188 is similar to lower scoring head 148 except that upper horizontal scoring disk 190 is offset downwardly relative to its axis of travel in order to enable a close face-to-face relationship between lower and upper horizontal scoring discs 186,190 as illustrated in dashed lines in FIG. 6. Head 188 includes solenoid valve 189 which operates pneumatic cylinder 191.

Figure 17:
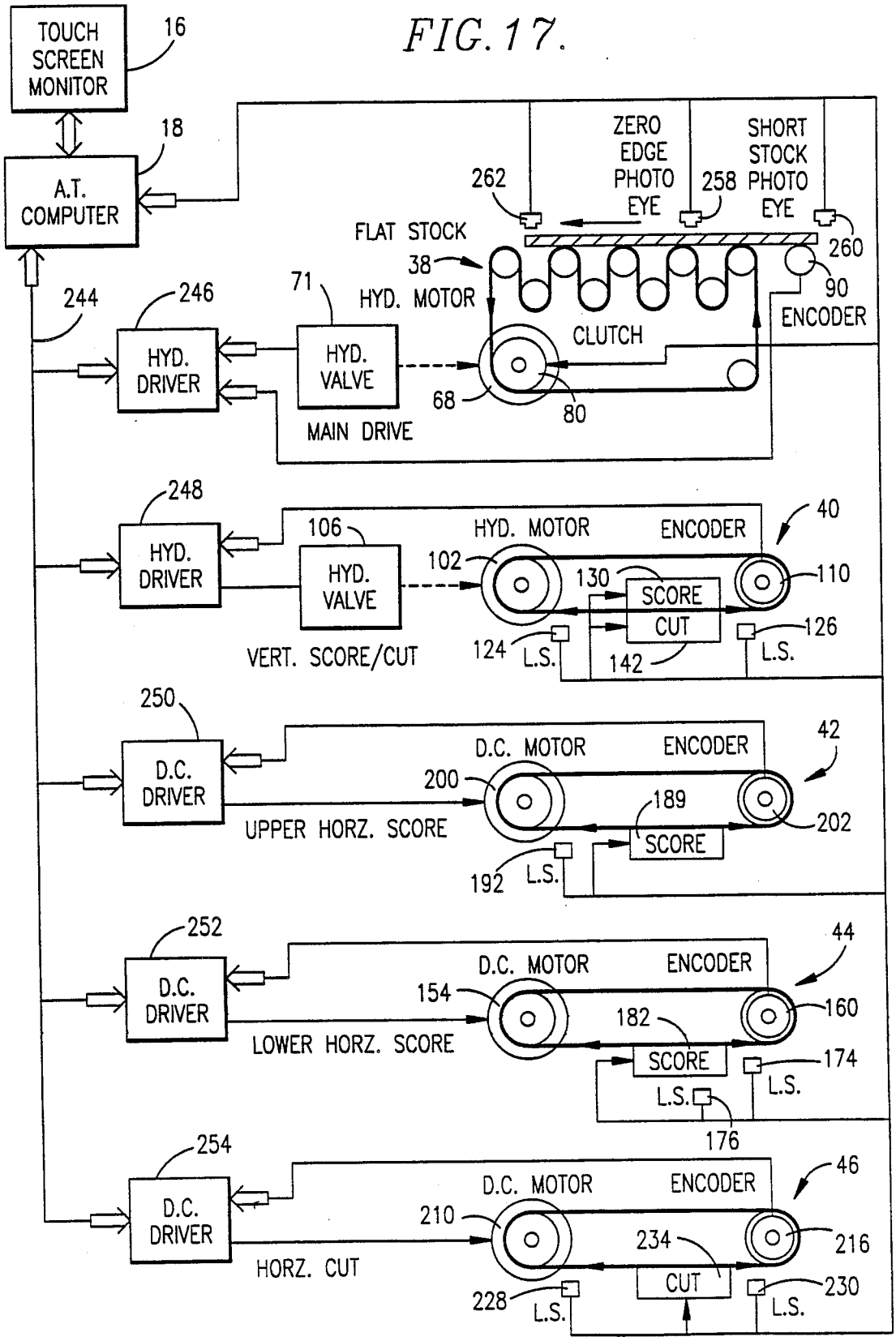
FIG. 17 is a schematic representation of the electronic and hydraulic components of the machine.

Upper horizontal score assembly 42 also includes upper limit switch 192 which defines the upward limit of travel of upper scoring head 188, upper and lower guide sheaves 194,196, V-belt 198, electric D.C. drive motor 200 (not shown but schematically illustrated in FIG. 17) mounted directly behind lower horizontal drive motor 154 and encoder 202 (FIG. 17). Assembly 92 further includes an encoder sheave, upper and lower corner idler sheaves, and drive idler sheave (not shown) which are identical to those components of assembly 44. One end of V-belt 198 connects to the leftward side of upper scoring head 188 (FIG. 8), extends about upper guide sheave 194 around the other drive components, and to lower guide sheave 196 so that the opposed end returns to couple with the leftward side of upper scoring head 188 at the lower portion thereof. Because lower scoring head 148 and upper scoring head 198 travel along the same left and right guide rails 148,150, stop limit switch 176 is included as redundant feedback to prevent destructive impact between heads 148,188.

Horizontal cut assembly 46 is the third operating work station for machine 20 and is designed to cut and thereby define the upper edge of the flat stock passing through machine 20 in order to form the finished container blank. Assembly 46 is generally disposed between drive roll pairs 52 and 54 as illustrated in FIG. 3 and is configured very similar to upper and lower horizontal score assemblies 42,44, the only difference being in the cutting blade portion of cutting head 204. That is to say, the idler pulleys and drive components are otherwise identical.

Horizontal cut assembly 46 includes cutting head 204, left and right guide rails 206 and 208, D.C. motor 210, drive sheave 212, drive idler sheave 214, encoder 216, encoder sheave 218, lower guide sheave 220, upper guide sheave 222, corner sheave 224, V-belt 226, and upper and lower limit switches 228 and 230.

Figure 14:
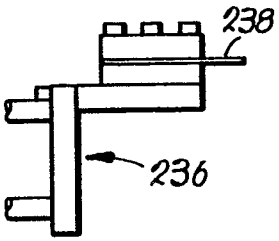
FIG. 14 is a fragmentary side elevational view of the horizontal cutting blade assembly of FIG. 13.
Figure 13:
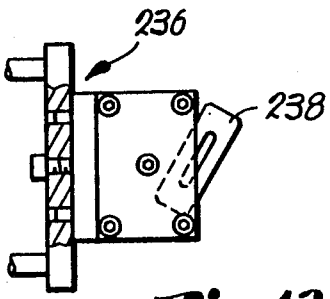
FIG. 13 is a fragmentary top plan view of the horizontal cutting blade assembly.
Figure 16:
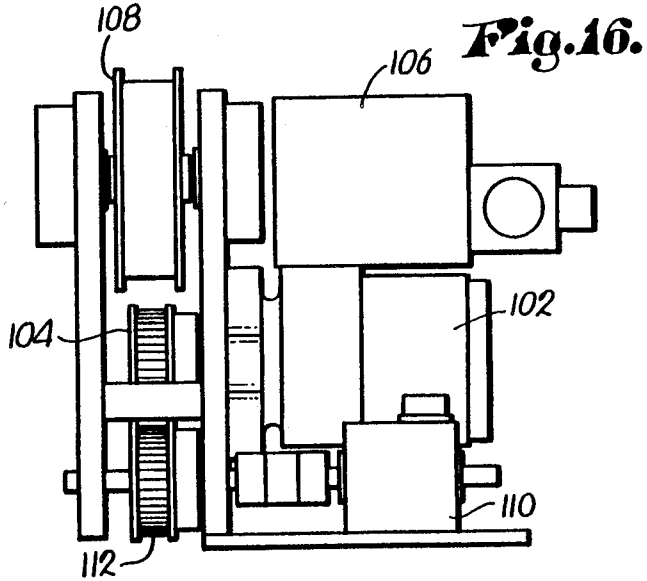
FIG. 16 is an enlarged end elevational view of the vertical score/cut drive unit.

Cutting head 204 includes pneumatic cylinder 232, solenoid valve 234, pneumatically axially shiftable cutting block 236 having cutting blade 238 fixedly connected to the inboard end thereof and offset upwardly as shown in FIG. 13 and 14. As illustrated in FIGS. 13 and 14, horizontal cutting blade 238 is preferably a razor blade or equivalent structure fixedly and replaceably clamped to cutting block 236.

Figure 7:
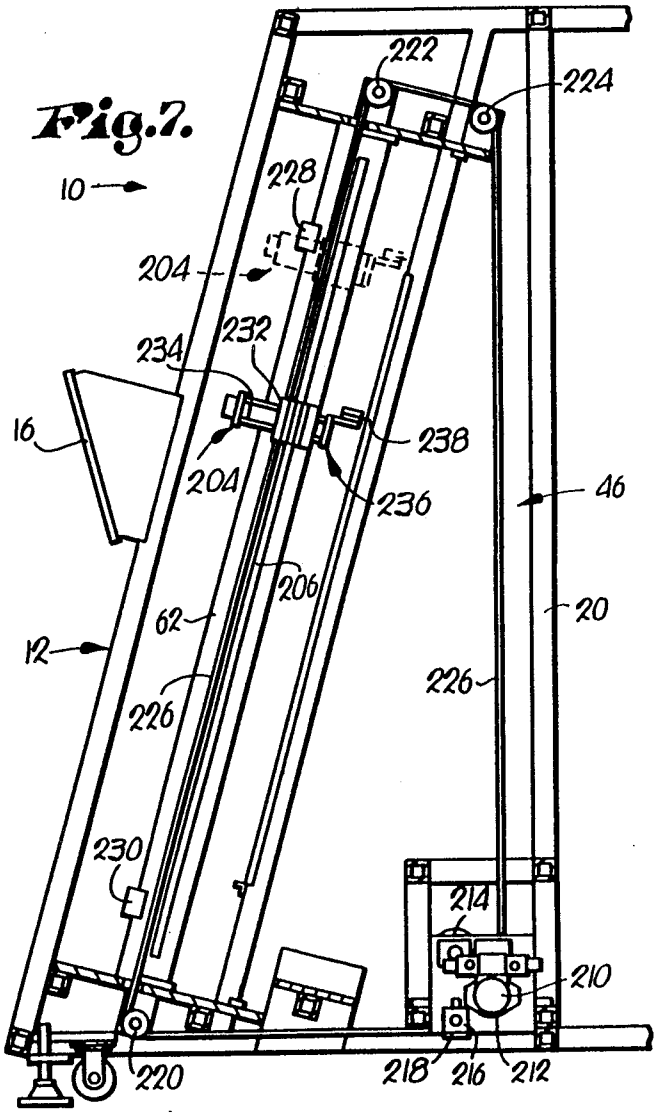
FIG. 7 is a vertical sectional view taken along line 7—7 of FIG. 3 showing the horizontal cut head and drive unit.
Figure 6:
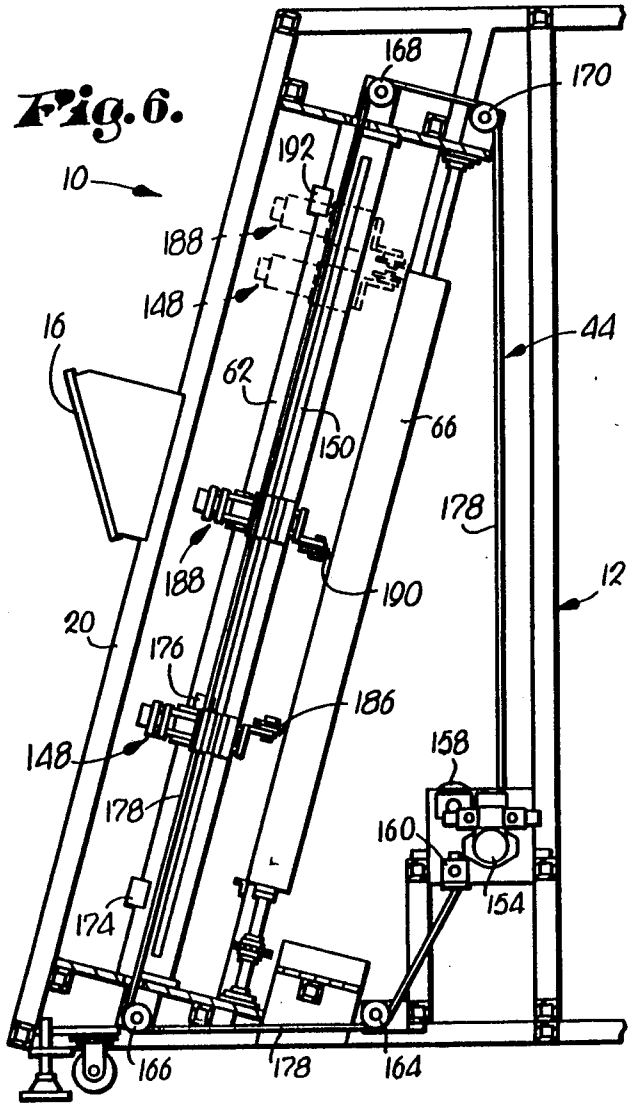
FIG. 6 is a vertical sectional view taken along line 6—6 of FIG. 3 showing the two horizontal score heads and one of the respective horizontal score drive units.

As shown in FIGS. 7 and 8, the respective ends of V-belt 226 are coupled to the leftward side of cutting head 204. Belt 226 extends upwardly from head 204 around upper guide sheave 222, corner sheave 224, drive sheave 212, drive idler sheave 214, encoder sheave 218, lower guide sheave 220, and back to cutting head 204. As illustrated in FIG. 7, reversible drive motor 210 is operable to shift cutting head 204 between the limits defined by upper and lower limit switches 228,230 along the guide rails 206,208 clamped thereto by left and right guide blocks 240,242.

B. Electrical and Control Structure

FIG. 17 is a schematic representation of the overall control of machine 10 illustrating the control interaction between the electrical, hydraulic, pneumatic, and mechanical components. Machine 10 is preferably designed to receive input power optionally at 240 v.a.c. or 480 v.a.c., for example, and further includes conventional A.C. and D.C. power supplies for providing operating power to monitor 16, computer 18, and the other electrical components of machine 10 as well as a conventional control to start and stop the hydraulic pump motor 36.

Touch screen monitor 16 is conventionally and serially interconnected with computer 18 to display appropriate screens generated by computer 18 and to provide operator "touch" input thereto.

Computer 18 is preferably an AT type unit having at least 640K RAM bytes of memory Hercules graphics board (monochrome), 40 megabyte hard disk drive, and RS232 serial port. Computer 18 includes a 96 bit parallel I/O board (ControVision brand) which is interconnected by way of fifty-line bus 244 to main driver circuit 246, vertical score/cut driver circuit 248, upper horizontal score D.C. driver circuit 250, lower horizontal score D.C. driver circuit 252, and horizontal cut D.C. driver circuit 254.

The internal I/O board also provides interconnections by various lines represented by bus 256 with the limit switches and pneumatic solenoids mentioned above, electric clutch 80, and with zero edge photoelectric eye 258 located between roll pairs 48 and score head 94, short stock photoelectric eye 260 located adjacent the rightward side of roll pair 48, and exit limit photoelectic eye 262 located adjacent the rightward side of roll pair 54, all as illustrated schematically in FIG. 17.

Figure 18:
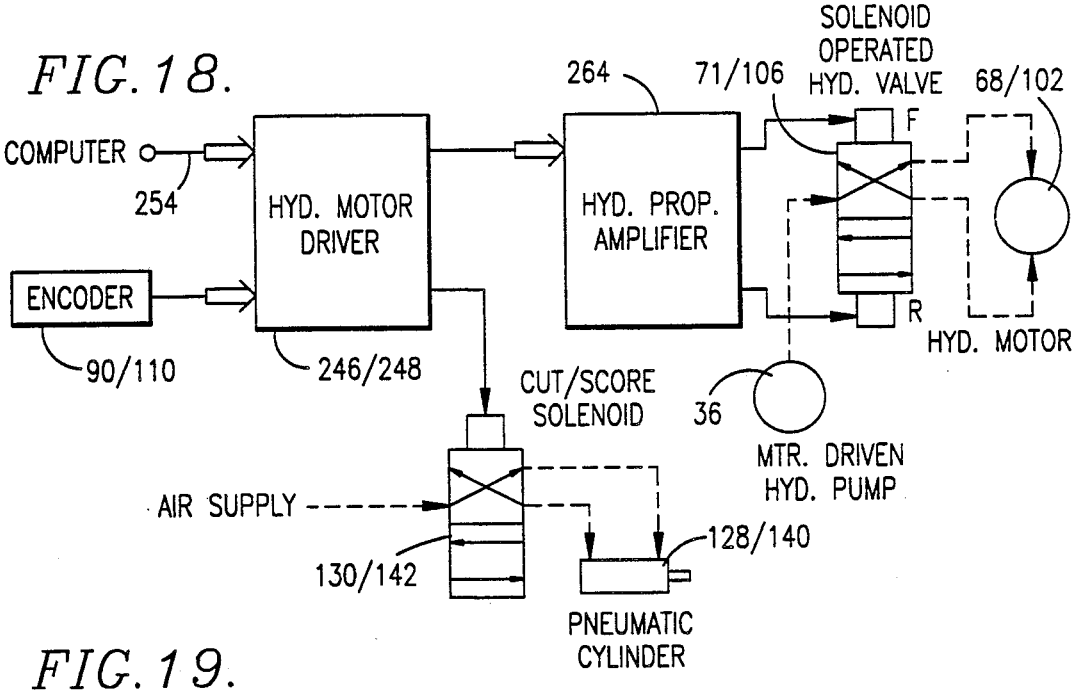
FIG. 18 is a schematic representation showing electrical, hydraulic, and pneumatic components of the driver control for the main drive and vertical score/cut heads.

FIG. 18 illustrates the electrical component interconnection for both main drive hydraulic motor 68 and vertical score/cut hydraulic motor 102. Conventional hydraulic motor driver circuits 246/248 receive inputs and outputs from computer 18 by way of bus 254 as mentioned above. In response, motor drive circuit 246/248 provides an output to hydraulic proportional amplifier 264 (Continental Model ECM5-RZ-PI-TI-24C,-A) which in turn provides outputs to the respective forward (F) or reverse (R) solenoids of the hydraulic valves 71,106 connected to the respective hydraulic motors 68,102. Hydraulic valve 71/106 is conventionally connected for hydraulic fluid input from hydraulic pump 36.

Hydraulic motor driver circuit 248 also provides outputs to respective solenoid valves 130,142 (only one of which is illustrated) in order to operate score and cut pneumatic cylinders 128,140 for controlling actuation thereof. Each hydraulic motor driver 246/248 also receives encoder inputs from respective encoders 90 and 110 which indicates the position of the connected components.

Figure 19:
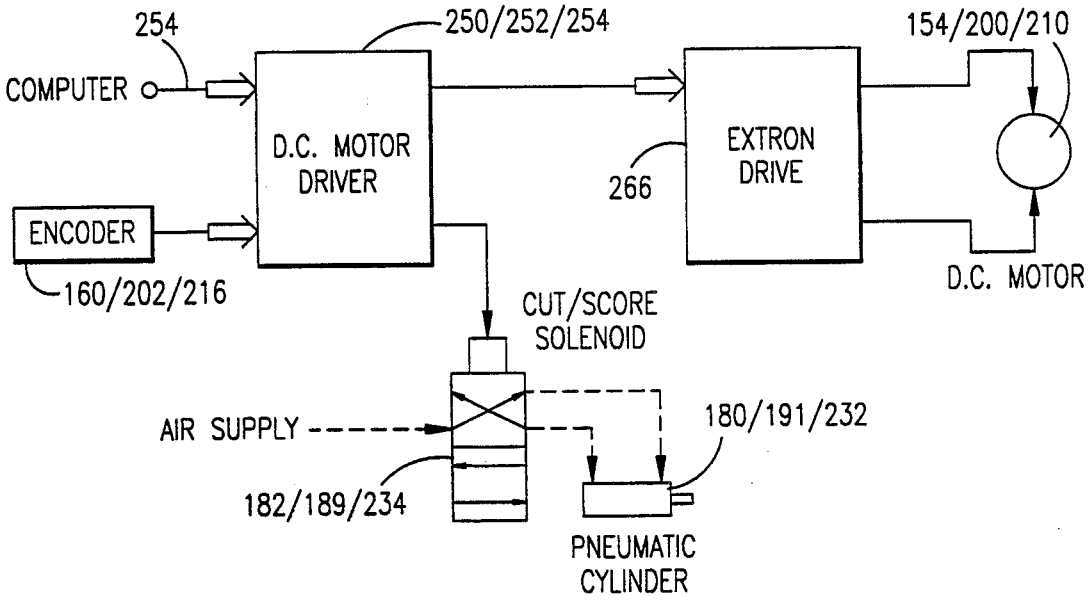
FIG. 19 is a schematic illustration of the electrical and pneumatic components of a typical D.C. driver of FIG. 17.

FIG. 19 illustrates a typical D.C. motor driver control circuit for upper horizontal score D.C. motor 200, lower horizontal score D.C. motor 154, and horizontal cut D.C. drive motor 210 As illustrated, each D.C. motor driver 250/252/254 provides an output to respective EXTRON electronic motor drivers (Model 181) which, in turn, drive connected D.C. motors 200/154/210. Each motor driver circuit also provides an output to respective solenoid valves 189,182,234 which respectively actuate pneumatic cylinders 180,191, and 232.

As can be appreciated, the air supply to the solenoid valves is conventionally supplied from available compressed "plant" air by way of flexible pneumatic air lines coupled with respective solenoid valves. As can also be appreciated, the electric lines supplying various solenoid valves (not shown) are also flexible and sufficiently long to follow the travel of various heads along their guide paths. Encoders 202,160, and 216 provide electronic position feedback to the D.C. motor driver circuits.

As an alternate embodiment, it is preferred that motors 200,154, and 210 be provided as hydraulic motive power from hydraulic pump 36. This provides advantages in lower cost, reduced electric "noise", and motor direction reversibility response. With these motors as hydraulic units, the respective solenoids can be directly controlled from circuits 250,252, and 254 without the need for a hydraulic proportional amplifier.

II. Operation

Figure 20:
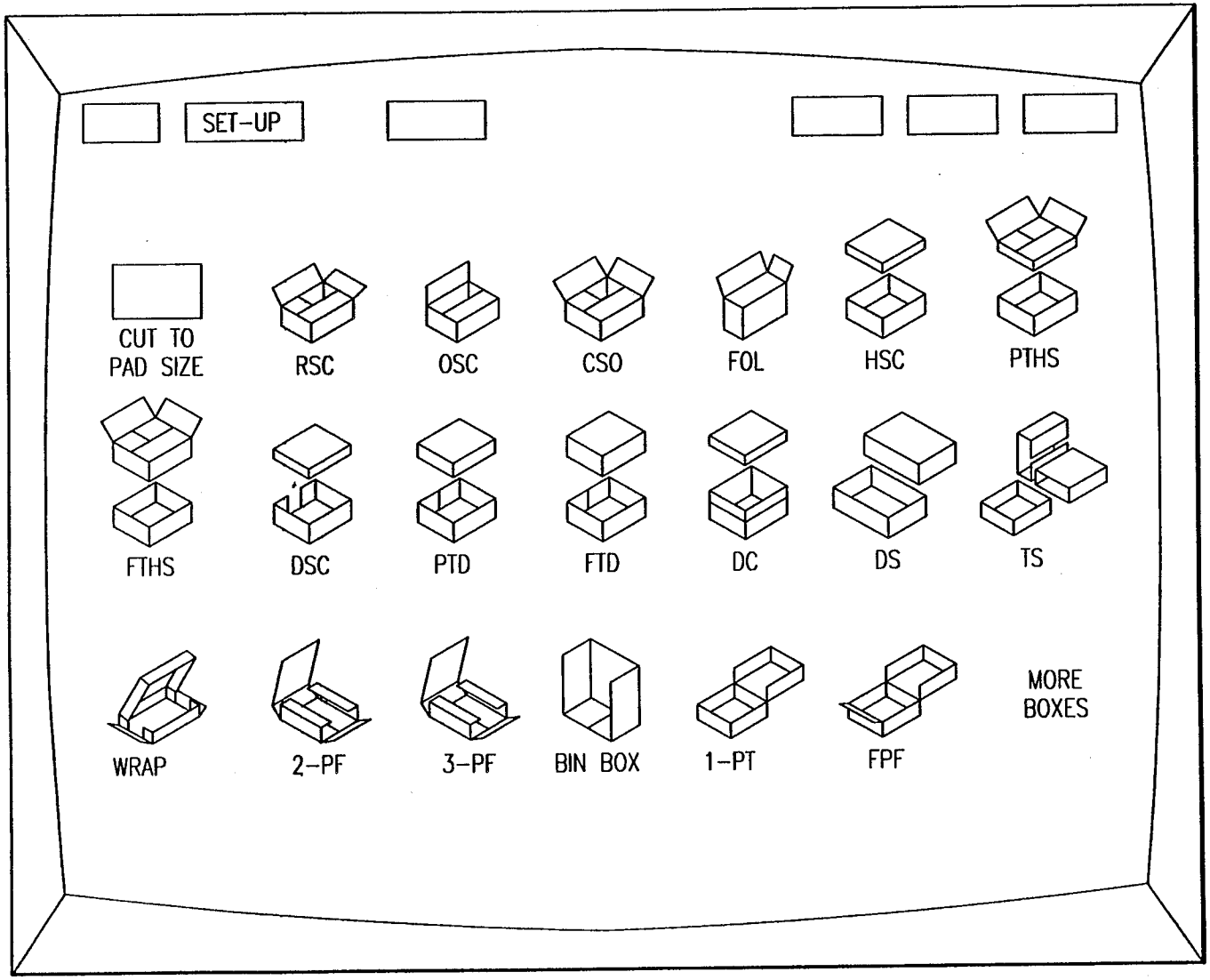
FIG. 20 illustrates the main menu screen on the touch screen monitor showing a variety of container types for operator selection.

By way of overview, and to illustrate the simplicity of operating container blank forming machine 10 from an operator's standpoint, FIG. 20 shows the initial screen image or "main menu" presented to the operator on touch screen monitor 16. This menu presents a wide variety of container types which machine 10 is capable of producing the appropriate score and cut blank. As shown, these containers are labeled with standard industrial abbreviations or codes such as "RSC" (regular slotted container). As noted in the lower righthand corner of FIG. 20, a command is available for "more containers" which illustrates that additional screens may be presented showing additional perspective views of even more types of containers. The "main menu" of FIG. 20 is presented to the operator on power up and the operator need only touch the screen image of the container desired on the basis of the perspective view or the container or the identification codes.

Figure 21:
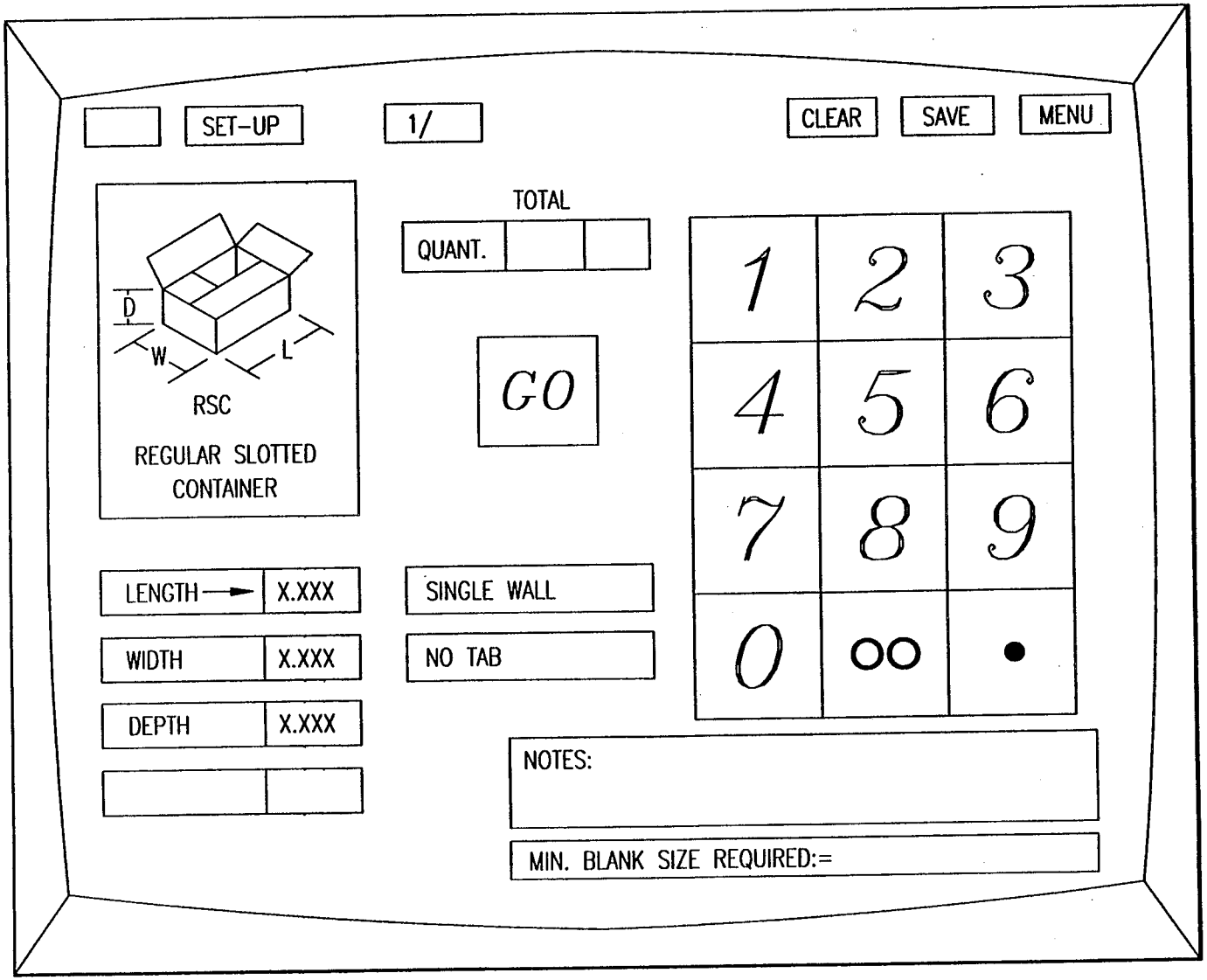
FIG. 21 illustrates the information input screen of the touch screen monitor for use by the operator to input data concerning a box selected by way of the menu screen of FIG. 20.

As an example, upon touching the "RSC" container image, computer 18, responds by presenting the "information input screen" illustrated in FIG. 21. The screen is configured to prompt the operator to enter the necessary data for forming the blank for the chosen RSC container. As FIG. 21 illustrates, the operator enters the interior length, width, and depth dimensions of the finished RSC container according to the illustration in the upper left corner. That is to say, the illustration provides the operator with the information needed to determine which dimension is the length, width, and depth. The dimension data is entered by touching the "key pad" image on the touch screen After entering the appropriate dimensions, the operator, if necessary, then touches the "single wall" box which toggles between single wall and "double wall" for the desired container. The operator then toggles the next box labeled "no tab" which toggles between the entry "no tab" and "tab" with each touch by the operator. The operator next enters the quantity desired by touching the appropriate key pad numbers which shows up adjacent the entry "QUANT" in the upper center of the information input screen.

After entry of this information, the operator then touches the box labeled "GO" whereupon computer 18 calculates the minimum blank size required to form the chosen container. This information is shown in the lower right portion of the screen. The operator then places the flat stock having at least the minimum dimensions against infeed bed 22 and supported by infeed support trough 28 and inserts the leading edge (that is, the leftward edge) into assembly enclosure 26 until the flat stock stops as it abuts infeed drive roll pair 48.

Figure 22:
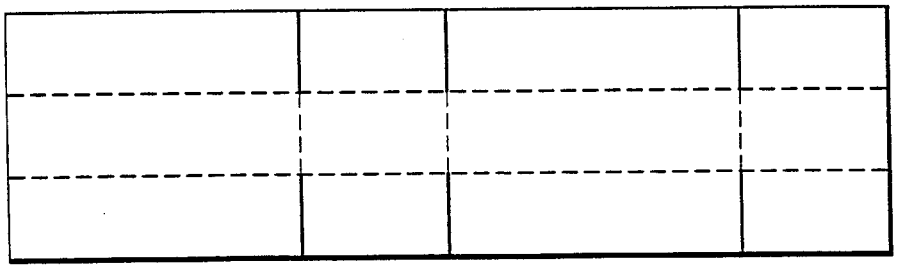
FIG. 22 is a plan view of a completed container blank with no tab with cuts represented by solid lines and scoring presented in dashed lines.

At this point, the main drive assembly shifts the blank through machine 10 between the respective nips of drive roll pairs 48–54, stopping as appropriate for the desired cutting and scoring operations performed by vertical score/cut, upper horizontal score, lower horizontal score, and horizontal cut assemblies 40–46. Upon completion, the blank exits assembly enclosure 26 onto outfeed bed 24 supported thereon by outfeed support trough 30. If more than one blank is desired, the operator successively feeds flat stock sections into machine 10 which forms blanks at the rate of about three to four per minute. FIG. 22 illustrates an "RSC" container blank formed by machine 10 with the solid lines illustrating cut lines and the dashed lines illustrating scores.

FIG. 23 is a computer program flowchart illustrating the "MAIN LOOP" routine 300 for operating computer 18 and thereby the other components of machine 10. The operating program is preferably written in the programming language known as QUICK BASIC. MAIN LOOP 300 enters at step 302 which, on power up, initializes all of the I/O ports and software variables. The program then moves to step 304 which executes a bit pattern test by sequentially sending a predetermined bit pattern to each hydraulic and D.C. motor driver 246–254 by way of bus 244 and in turn sequentially reads each pattern to ensure proper data transmission and receipt. The program then moves to step 306 to retrieve from memory and display the main screen menu of FIG. 20.

In step 308, computer 18 receives selection data from the operator of machine 20 in response to the operator's touch of a selected container, such as "RSC" discussed above. Upon receipt of this information, the program moves to step 310 and retrieves from memory and displays the information input screen illustrated in FIG. 21.

In step 312, the program receives data input from touch screen monitor 16 representative of the interior dimensions of the chosen container—specifically the length (L), width (W), and depth (D), along with the stock thickness (single wall or double wall), tab type (tab or no tab) and quantity of blanks to be produced as well as other variables and parameters. As those skilled in the art will appreciate, a particular box having specific dimensions which is frequently produced can be prestored in memory whereupon only quantity data need be provided as input in step 312. Such preset data can be indicated on the main screen by an additional memory entry such as "RSC-1" indicating a particular RSC-type box having predetermined dimensions.

The program then moves to step 314 whereupon it waits until the operator touches "GO" on the information input screen whereupon the program moves to step 316 to perform the necessary calculations to form the blank for the selected container. As those skilled in the art will appreciate, these calculations are specific for the type of box selected, dimensions, and other input data. For example, for an RSC box having a length of 24", width of 12", and depth of 6", each flap would need to be 6" and, in this example, the box depth is also 6". Thus, horizontal score assembly 44 would need to be operated to place horizontal scoring disc 186 six inches above the bottom of the flat stock plus bend allowance. In this regard, encoder sheave 162 presents a lineal travel of 7.1 inches per revolution and 600 pulses per revolution. This translates into approximately 507 pulses above the "home" position adjacent lower limit switch 174. Similarly, the upper horizontal score line is 12 inches above the bottom of the blank plus bend allowance in the example which translates into approximately 1014 pulses above the bottom of the flat stock.

Continuing with the example, and with reference to FIG. 22, the required horizontal cut is 18" above the bottom of the flat stock which translates into 1521 pulses of movement above the lower edge of the flat stock in order to place cutting blade 238 eighteen inches above the bottom of the flat stock.

Continuing with the example, the first vertical cuts and scores would need to occur at 24 inches plus bend allowance from the leading, that is, the leftward edge of the flat stock. For main drive assembly 38, this translates into about 1200 pulses. That is to say, main drive assembly 38 is configured to provide 12 inches of lineal flat stock travel for each revolution of encoder 110 which also provides 600 pulses per revolution. At this location (about 24 inches from the leading edge of the flat stock), two vertical cuts, 6 inches each, separated by a 6" vertical score need to be produced by vertical score/cut assembly 40. Starting adjacent lower limit switch 124, cutting head 96 and vertical score/cut drive motor 102 and cut solenoid 142 would need to be operated for 507 pulses from lower limit switch 124, scoring head solenoid 130 energized for an additional 507 encoder pulses as vertical drive motor 102 continues to shift scoring and cutting heads 94,96 upwardly, whereupon cutting head 96 would again be energized for an additional 507 pulses to complete the upper vertical cut. In the alternative, the vertical score/cut action can be accomplished from top to bottom to prevent uplifting of the flat stock. Step 316 performs similar calculations for the remaining two vertical score/cut lines as illustrated in FIG. 22 and a further calculation to cut the trailing edge of the flat stock to length in order to produce the completed container blank as illustrated in FIG. 22.

As those skilled in the art will appreciate, similar types of calculations as a function of the number of pulses received from the various encoders would need to be performed for each type of box stored in memory, taking into account dimensions and other input variables.

Step 316, in performing these calculations, also calculates and transmits the overall minimum blank size requirements for immediate display on the information input screen (FIG. 21). Additional messages can also be displayed, for example, "label this container fragile".

The program then moves to step 318 which asks whether the calculations of step 316 produced an error condition. An error condition might exist if input dimensions were provided by the operator of which the machine is not capable of performing, or which are inconsistent so that a solution to the calculations in step 316 is not possible. If such a condition exists, the program moves to step 320 which displays the appropriate error message in the box labeled "notes" on the information input screen. After displaying this message for a predetermined time as a matter of design choice, the program loops back to the previous menu such as 310 to again display the information input screen which prompts the operator to start again.

If no error condition exists in step 318, the program moves to step 320 which loads the data calculated in step 316 to motor drivers 248–254 by way of bus 244. Each driver circuit receives and stores the data for execution on command. Note that the data for main driver 246 is not loaded in this step in order to allow time for motors 102, 200, 154, and 210 to shift to their initial position which is prompted by the command in next step 322. That is to say, step 322 delivers the command to each driver circuit 248–254 to energize respective motors 102, 200, 154, and 210 until the respective encoders 110, 202, 160, and 216 feed back the required number of pulses to the respective driver circuits in accordance with the calculated data.

Figure 24:
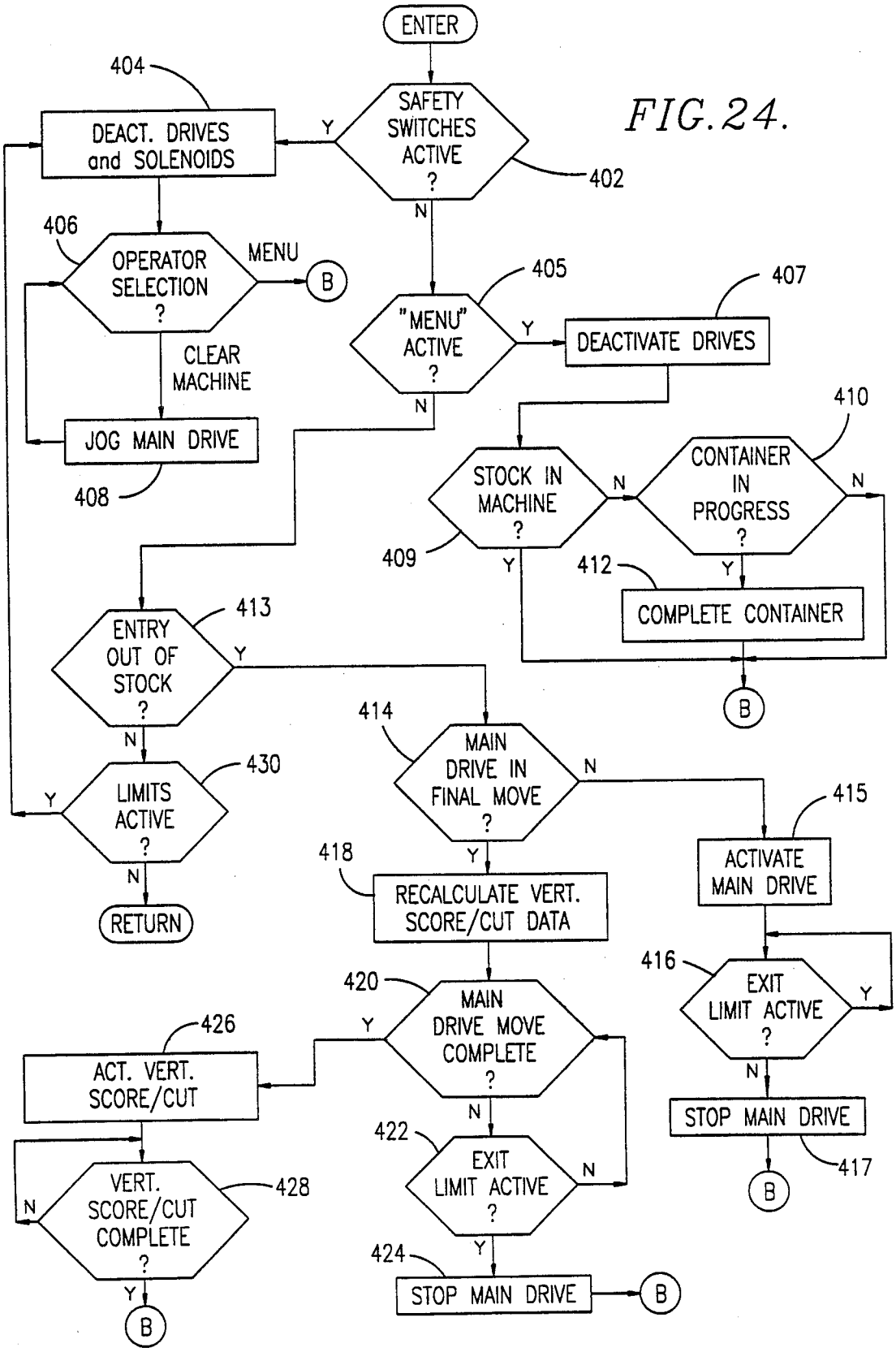
FIG. 24 is a computer program flowchart illustrating the LIMIT CHECKS subroutine of FIG. 23.

The program then moves to step 324 to execute the subroutine "LIMIT CHECKS" (FIG. 24). This subroutine, discussed further hereinbelow, checks the various safety limit switches and input commands from the operator before proceeding.

After executing subroutine "LIMIT CHECKS" in step 324, the program moves to step 326 which asks whether motor driver circuits 248–254 indicate that the requested movements of the motors have been completed. If no, the program continues to loop back through step 324 until complete after which the program moves to step 328 which activates the upper and lower horizontal score solenoids 189,182. That is to say, this step causes the respective pneumatic cylinders to shift the scoring heads forward into their scoring position so that they are in position to begin scoring the flat stock as it moves through machine 10 in accordance with the calculations in step 316.

The program then moves to step 330 which asks whether the short stock sensor is active. As mentioned above in connection with FIG. 17, machine 10 includes a short stock photoeye adjacent to the rightward side of infeed drive roll pair 48. An active sensor indicates that flat stock is present and ready for feeding into machine 10. The program then moves to step 332 which loads the movement data to main driver circuit 246 whereupon the program moves to step 334 and activates main drive motor 68.

The program then moves to step 336 which executes subroutine "LIMIT CHECKS" (FIG. 24) after which the program moves to step 338 which asks whether the main drive movement is completed for the first increment, that is to say, whether the main drive has moved the flat stock into position for execution of the first vertical cuts and scores. If not, the program continues to loop through step 338 until complete. The program then moves to step 340 which activates vertical score and cut driver 248 and sequentially activates score solenoid 130 and cut solenoid 142 in accordance with the data calculated in step 316. While this is occuring, the program then executes subroutine LIMIT CHECKS in step 342 until the vertical scoring and cutting operations are complete as decided in step 344.

After step 344, the program moves to step 346 which asks whether formation of the container blank is complete, that is, whether all the operations required have been accomplished. If not, the program loops back to step 332 which loads the next sequence of main drive data into main driver circuit 246 for the next increment of movement of the flat stock through machine 10. The program continues to loop through steps 332–346 until all of the vertical cutting and scoring operations have been completed upon each incremental movement of the flat stock through machine 10.

When a particular container blank formation has been completed, the program moves to step 348 which asks whether the total quantity of blanks to be produced has been completed. If no, the program loops back to step 332 which again loads the beginning increment of main drive data for the next container blank. When the answer in step 348 is yes, indicating what the total number of required container blanks have been produced, the program loops back to the previous menu, step 310, for example, in readiness for the next operation.

FIG. 24 illustrates subroutine "LIMIT CHECKS" 400 which enters at step 402. This step asks whether any safety switches are active. As a safety matter, it is preferred that enclosure doors 32,34 be equipped with safety switches to suspend operation of machine 10 in the event these doors are opened during operation. As those skilled in the art will appreciate, various other safety devices can be incorporated as needed in order to prevent injury to personnel and damage to the equipment.

If the answer in step 402 is yes, the program moves to step 404 which deactivates all of the drive motors and solenoids. The program then moves to step 406 which asks whether the operator has depressed the "clear" selection or "menu" selection displayed in the upper right corner of the information input screen (FIG. 21). If the menu selection has been touched, the program loops back to main loop step 306 to display the main menu. If "clear" has been touched, the program moves to step 408 to jog main drive motor 68 in order to aid the operator in clearing the machine of any jammed flat stock. The program then loops back to step 306 which allows the operator to again jog the machine or exit to the main menu. As those skilled in the art will appreciate, other corrective functions can be available for selection by the operator such as "cut" the flat stock present in machine 10.

If no safety switches are active in step 402, the program moves to step 405 which asks whether "menu" on the information input screen is active. If yes, the program deactivates all drives and solenoids in step 407 and then moves to step 409 which asks whether any flat stock is in the machine as indicated by an active exit limit switch 262 or zero edge photoeye 258. If yes, the program moves to step 410 which asks whether formation of a container blank is in progress. If no, indicating that the operator has not yet fed additional flat stock into machine 10, the program loops back to main loop step 306. This step is useful in allowing the operator to effectively interrupt and cancel a quantity run of container blanks by touching the "menu" block on the information input screen.

If the answer in step 410 is yes, indicating that a container blank is in the process of being produced, the program moves to step 412 to complete that blank before looping back to main loop step 306. If the answer in step 409 is no, the program loops back to main loop step 306.

If the answer in step 405 is no, the program moves to step 413 which asks whether the entry is out of flat stock, that is, whether the short stack photoeye is not active. If yes, the program moves to step 414 which asks whether the main drive is in its final move. If no, the program moves to step 415 which activates the main drive for its final move and then moves to step 416 which asks the exit limit switch 262 is active. If yes, indicating that the blank has not yet exited the machine, the program continues to loop through this step until the exit limit switch is clear indicating that the container blank formation is complete. The program then moves to step 417 which stops main drive motor 68 and then loops back to main loop step 306.

If the answer in step 417 is yes, the program moves to step 418 to recalculate the vertical score and cut data. This is done to prevent cutting off a stock piece having a width less than the spacing between feed roller pairs which would cause a piece of stock to be left in machine 10.

The program then moves to step 420 which asks whether main drive movement has been completed. If no, the program moves to step 422 which asks whether the exit limit switch is active. If no, the program continues to loop back through step 420 until the answer in step 422 is yes whereupon the program stops the main drive in step 424 and loops back to main loop step 306.

If the answer in step 420 is yes, indicating that all the main drive movement increments have been completed, except for the final one of ejecting the flat stock, the program moves to step 426 which activates vertical score/cut driver circuit 248 to complete its final operation after which the program moves to step 428 and continues to loop therethrough until the vertical score/-cut operation is complete after which the program loops back to main drive step 306.

If the answer in step 413 is no, indicating that flat stock is available for processing, the program moves to step 430 which asks whether any machine limit switches are active. If yes, which indicates a malfunction, the program moves to step 404 discussed above. If the answer in step 430 is no, indicating a normal condition, the program returns to the main loop and continues on through.

Having thus described the preferred embodiment of the present invention, the following is claimed as new and desired to be secured by Letters Patent:

1. A machine for producing container blanks from flat stock comprising:

a frame;

assembly means coupled with said frame and controllably operable for selectively performing cutting and scoring operations on flat stock for producing a container blank therefrom; and control means operably coupled with said assembly means for controlling the operation thereof, said control means including information means for receiving container information comprising an operator input selection denoting a desired container, means responsive to said container information for determining container blank information in accordance therewith including cut and score data representative of a corresponding container blank from which said desired finished container is to be formed, and means responsive to said blank information for controlling the operation of said assembly means to cut and score the stock in accordance therewith for producing said corresponding container blank from flat stock.

2. The machine as set forth in claim 1, said frame including structure for supporting flat stock in a generally upright position during said operations in order to present a compact configuration of said machine.

3. The machine as set forth in claim 2, said supporting structure supporting flat stock at about 15 degrees relative to vertical.

4. The machine as set forth in claim 1, said assembly including shifting means for controllably shifting flat stock through said machine in order to selectively position the flat stock in said machine for performing said operations.

5. The machine as set forth in claim 4, said frame including respective infeed and outfeed beds, said shifting means including means controllably shifting flat stock and performing said operations between said beds.

6. The machine as set forth in claim 1, said assembly means including first means for performing at least one of scoring and cutting operations on flat stock in a first direction relative to the flat stock, and second means for performing scoring and cutting operations on the flat stock in a second, different direction.

7. The machine as set forth in claim 6, said first and second means each including selectively shiftable and activatable, cutting and scoring heads.

8. The machine as set forth in claim 6, said directions being at right angles to one another.

9. The machine as set forth in claim 6, said frame including structure for supporting flat stock in a generally upright position during said operations, said directions including vertical and horizontal directions respectively.

10. The machine as set forth in claim 1, said container information including the type of container, interior dimensions and quantity to be produced of said desired container.

11. The machine as set forth in claim 1, said information means including a touch screen video monitor operable for displaying video images and for receiving information in response to the touch of a corresponding image displayed thereon.

12. The machine as set forth in claim 11, said determining means including computer means operably coupled with said monitor for generating selected images thereon and for responding to information received thereby.

13. The machine as set forth in claim 12, said computer means being further operable for generating container images on said monitor representative of a plurality of selectable containers for responding to the touch of a selected container image as said desired container in order to determine said blank information in response.

14. The machine as set forth in claim 13, said container information including the type of the desired container and the interior dimensions thereof, said blank information including information representative of the required scores and cuts to be preformed on flat stock in order to form said corresponding container blank, said computer means being responsive to said container information for calculating said blank information in accordance with said container type.

15. The machine as set forth in claim 1, said assembly means including activatable motor means for controlling said operations, said control means including motor driver control circuit means for receiving said blank information and for activating said motor means in response thereto.

* * * * *